US008322706B2

(12) United States Patent
Sunohara

(10) Patent No.: US 8,322,706 B2
(45) Date of Patent: Dec. 4, 2012

(54) MEDIUM TRANSPORT DEVICE AND IMAGE FORMING APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 697 days.

(21) Appl. No.: 11/892,471

(22) Filed: Aug. 23, 2007

(65) Prior Publication Data

US 2008/0050159 A1 Feb. 28, 2008

(30) Foreign Application Priority Data

Aug. 25, 2006 (JP) ..... 2006-229724

(51) Int. Cl.
*B65H 3/52* (2006.01)

(52) U.S. Cl. ..... 271/121; 271/167

(58) Field of Classification Search ..... 271/121, 271/167

See application file for complete search history.

(56) References Cited

U.S. PATENT DOCUMENTS

| | | | | |
|---|---|---|---|---|
| 6,149,045 | A * | 11/2000 | Kadono | 226/196.1 |
| 6,293,541 | B1 * | 9/2001 | Horiuchi et al. | 271/184 |
| 6,371,479 | B1 * | 4/2002 | Osaka et al. | 271/186 |
| 7,568,690 | B2 * | 8/2009 | Kurokawa et al. | 271/9.09 |
| 7,578,499 | B2 * | 8/2009 | Watanabe | 271/113 |
| 7,661,673 | B2 * | 2/2010 | Doyo | 271/264 |
| 2003/0155702 | A1 * | 8/2003 | Togashi et al. | 271/121 |
| 2003/0209852 | A1 * | 11/2003 | Choi | 271/291 |
| 2004/0041334 | A1 * | 3/2004 | Yoshihara | 271/145 |
| 2004/0145719 | A1 * | 7/2004 | Kawai et al. | 355/407 |
| 2004/0251621 | A1 * | 12/2004 | Suzuki et al. | 271/298 |
| 2005/0196216 | A1 * | 9/2005 | Tanahashi et al. | 400/625 |
| 2006/0071417 | A1 * | 4/2006 | Baba | 271/264 |
| 2007/0152398 | A1 * | 7/2007 | Watanabe | 271/264 |
| 2009/0324311 | A1 * | 12/2009 | Matsumoto | 399/400 |

FOREIGN PATENT DOCUMENTS

| | | |
|---|---|---|
| JP | 63-042641 U | 3/1988 |
| JP | 01-123646 U | 8/1989 |
| JP | 05-072843 U | 10/1993 |
| JP | 06-032488 | 2/1994 |
| JP | 07-076438 | 3/1995 |
| JP | 08-157107 | 6/1996 |
| JP | 09-235041 | 9/1997 |
| JP | 10-171199 | 6/1998 |
| JP | 10-316273 | 12/1998 |
| JP | 2001-031264 | 2/2001 |

* cited by examiner

*Primary Examiner* — Michael McCullough
*Assistant Examiner* — Howard Sanders
(74) *Attorney, Agent, or Firm* — Kubotera & Associates, LLC

(57) ABSTRACT

A medium transport device includes a transport unit for transporting a medium, and a guide member disposed on a downstream side of the transport unit in a direction that the medium is transported. The guide member includes a first portion corresponding to the transport unit and a second portion having a shape different from that of the first portion.

8 Claims, 15 Drawing Sheets

MEDIUM TRANSPORT DEVICE AND IMAGE FORMING APPARATUS

BACKGROUND OF THE INVENTION AND RELATED ART STATEMENT

The present invention relates to a medium transport device and an image forming apparatus.

In a conventional image forming apparatus such as a printer, a copier, a fax machine, and a multifunction machine thereof, an image forming unit forms a toner image according to print data, and a transfer unit transfers the toner image to a sheet as a medium. Then, the sheet is transported to a fixing device, thereby fixing the toner image. Afterward, the sheet is discharged to a specific location with a pair of transport rollers.

In the conventional image forming apparatus such as a printer, a sheet cassette is detachably attached to an apparatus main body of the printer for storing the sheet. In the sheet cassette, a medium placing base is rotatably disposed on a support shaft for placing the sheet. Further, in the sheet cassette, a medium regulating member is disposed for regulating a position where the sheet is placed, so that the medium regulating member positions the sheet in a direction that the sheet is transported and a direction perpendicular to the direction that the sheet is transported.

Further, the conventional image forming apparatus is provided with a sheet supply roller; a separation member facing the sheet supply roller; and a pressing member pressing the separation member, so that the sheet is supplied from the sheet cassette. A guide member formed of a base portion and a plurality of rib portions is disposed at a downstream side of the sheet supply roller for supplying the sheet. The rib portions have an identical shape. A pair of the transport rollers is disposed at a downstream side of the guide member.

When a sheet supply motor drives the sheet supply roller to rotate at a constant speed, the sheet is picked up from the medium placing base. Then, the sheet is transported to a nip portion between the sheet supply roller and the separation member to be separated one by one, and is transported to the guide member. Accordingly, the sheet passes through a medium sensor while abutting against the rib portions of the guide member, and is transported to a pair of the transport rollers.

A control unit controls the transport rollers to rotate for transporting the sheet according to a timing when the sheet passes through the medium sensor. In general, the control unit controls the transport rollers not to start rotating for a specific period of time after the sheet passes through the medium sensor, so that the sheet is pushed into the transport rollers to correct skew thereof (refer to Patent Reference). Patent Reference Japan Patent Publication No. 10-171199

In the conventional printer, when a front edge of the sheet is caught with a distal end of the rib portion and bent, a transport jam may occur.

In the view of the problem described above, an object of the present invention is to provide a medium transport device and an image forming apparatus capable of solving the problem and preventing a transport jam of a sheet.

Further objects and advantages of the invention will be apparent from the following description of the invention.

SUMMARY OF THE INVENTION

In order to attain the objects described above, according to the present invention, a medium transport device includes a transport unit for transporting a medium, and a guide member disposed on a downstream side of the transport unit in a direction that the medium is transported. The guide member includes a first portion corresponding to the transport unit and a second portion having a shape different from that of the first portion.

In the present invention, the second portion has a shape different from that of the first portion corresponding to the transport unit. Accordingly, it is possible to prevent a front edge of the medium from being caught with the guide member, thereby preventing a transport jam.

DESCRIPTION OF THE PREFERRED EMBODIMENTS

Hereunder, embodiments of the present invention will be explained with reference to the accompanying drawings. In the description below, a color printer is described as an example of an image forming apparatus. The printer forms an image on a sheet as a recording medium through an electrophotography method according to print data as image data sent from an external computer.

First Embodiment

Figure 2:
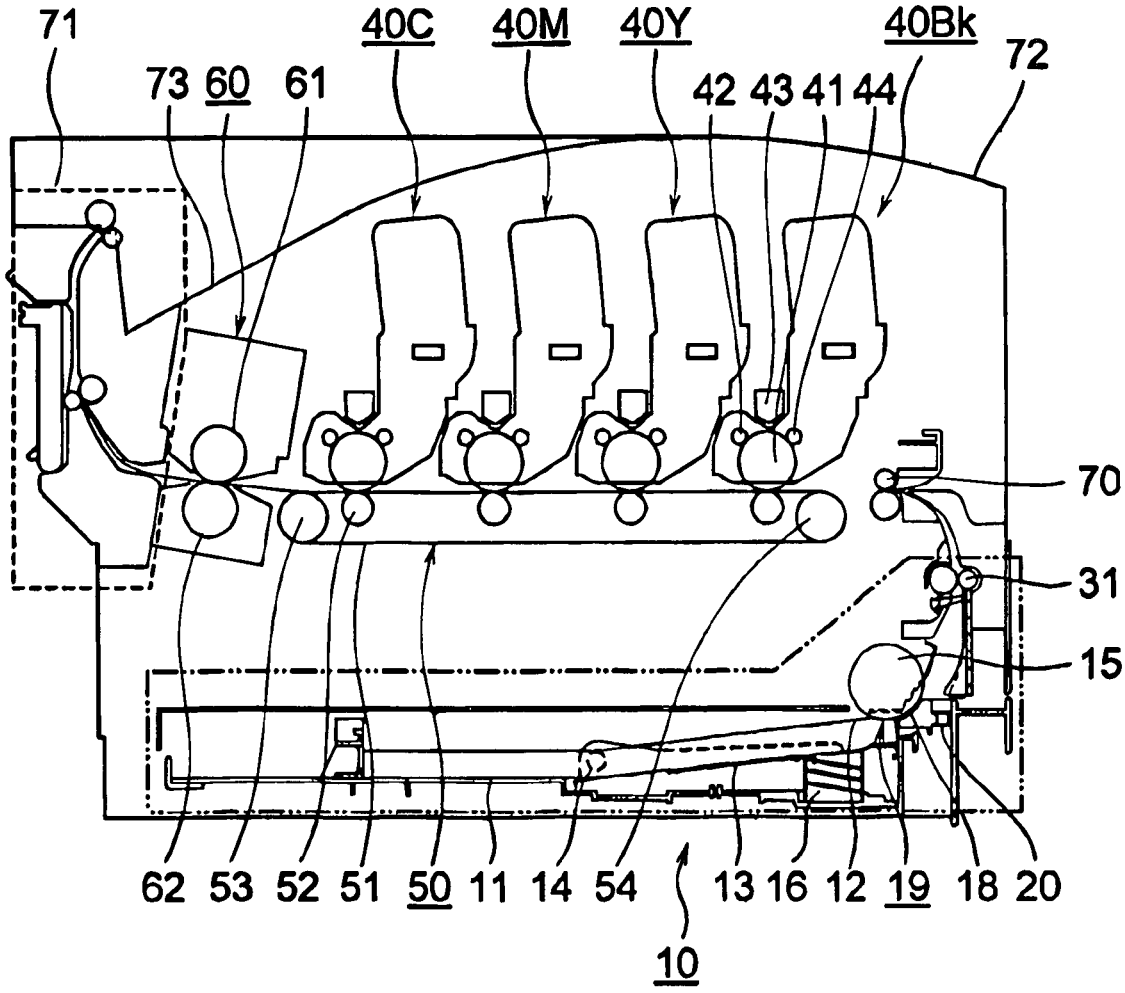
FIG. 2 is a schematic view showing a printer according to the first embodiment of the present invention.

FIG. 2 is a schematic view showing a printer according to the first embodiment of the present invention. As shown in FIG. 2, the printer has image forming units 40Bk, 40Y, 40M, and 40C as image forming devices; a sheet supply unit 10; a transfer transport belt unit 50; a fixing device 60 as a fixing unit or a fixing apparatus; a sheet discharge unit 71; and a medium placing portion 73 disposed at an upper portion of a printer main body and an apparatus main body 72 for placing a sheet 12 as a recording medium with an image forming surface of the sheet 12 facing downward.

In the embodiment, each of the image forming units 40Bk, 40Y, 40M, and 40C includes a photosensitive drum 41 as an image supporting member; a developing roller 44 as a developer supporting member; a charging roller 42 as a charging device; and the likes. An LED (light emitting diode) head 43 is disposed above the photosensitive drum 41 as an exposure device, and an LED element (not shown) as a light emitting element is arranged in the LED head 43 along an axial direction of the photosensitive drum 41. Instead of the LED head 43, there may been provided a laser scanning unit having a laser radiation unit and a polygon mirror.

In each of the image forming units 40Bk, 40Y, 40M, and 40C, the charge roller 42 uniformly charges a surface of the photosensitive drum 41, and the LED head 43 exposes the surface, so that a static latent image (not sown) is formed on the surface of the photosensitive drum 41. The developing roller 44 develops the static latent image to form a toner image as a developer image.

In the embodiment, a sheet supply cassette 11 is detachably attached to the apparatus main body 72 as a medium storage unit of the sheet supply unit 10. A medium placing base 13 is disposed in the sheet supply cassette 11 to be freely rotatable around a supporting shaft 14, so that the sheet 12 is placed on the medium placing base 13. A sheet regulating member (not shown) is disposed in the sheet supply cassette 11 for regulating a position of the sheet 12, so that the sheet 12 is positioned in a transport direction that the sheet 12 is transported and a direction perpendicular to the transport direction.

In the embodiment, the sheet 12 is placed on the medium placing base 13, and the sheet 12 at an uppermost position abuts against a sheet supply roller 15 as a transport member and a pick-up member. A pushing spring 16 as a pushing member is disposed on the medium placing base 13 for pushing the medium placing base 13 toward the sheet supply roller 15, so that the sheet 12 placed on the medium placing base 13 is pressed against the sheet supply roller 15. The sheet supply roller 15 is disposed against the sheet 12 at the upper most position at a front edge of the sheet 12 in the transport direction.

In the embodiment, a separation member 18 is disposed at a position facing the sheet supply roller 15, and a pressing member 20 presses the separation member 18 against the sheet supply roller 15. A pair of transport rollers 31 is disposed on a downstream side of the sheet supply roller 15 in the transport direction of the sheet 12, and a pair of transport rollers 70 is disposed on a downstream side of the transport rollers 31.

In the embodiment, the transfer transport belt unit 50 is provided with a drive roller 53 as a first roller; a follower roller 54 as a second roller; a transport belt 51 placed between the drive roller 53 and the follower roller 54 to be freely movable; and a transfer roller 52 for transferring the toner image formed on the photosensitive drum 41 to the sheet 12. When the drive roller 53 rotates, the transport belt 51 moves and the follower roller 54 follows the transport belt 51 to rotate. Accordingly, the transfer roller 52 sequentially transfers the toner image in each color formed on the photosensitive drum 41 to the sheet 12, thereby forming a toner image in colors.

In the embodiment, the fixing device 60 is provided with a fixing roller 61 as a first rotating member and a pressing roller 62 as a second rotating member. The fixing device 60 fixes the toner image in colors formed with the image forming units 40Bk, 40Y, 40M, and 40C and transferred to the sheet 12, thereby forming a color image.

Figure 1:
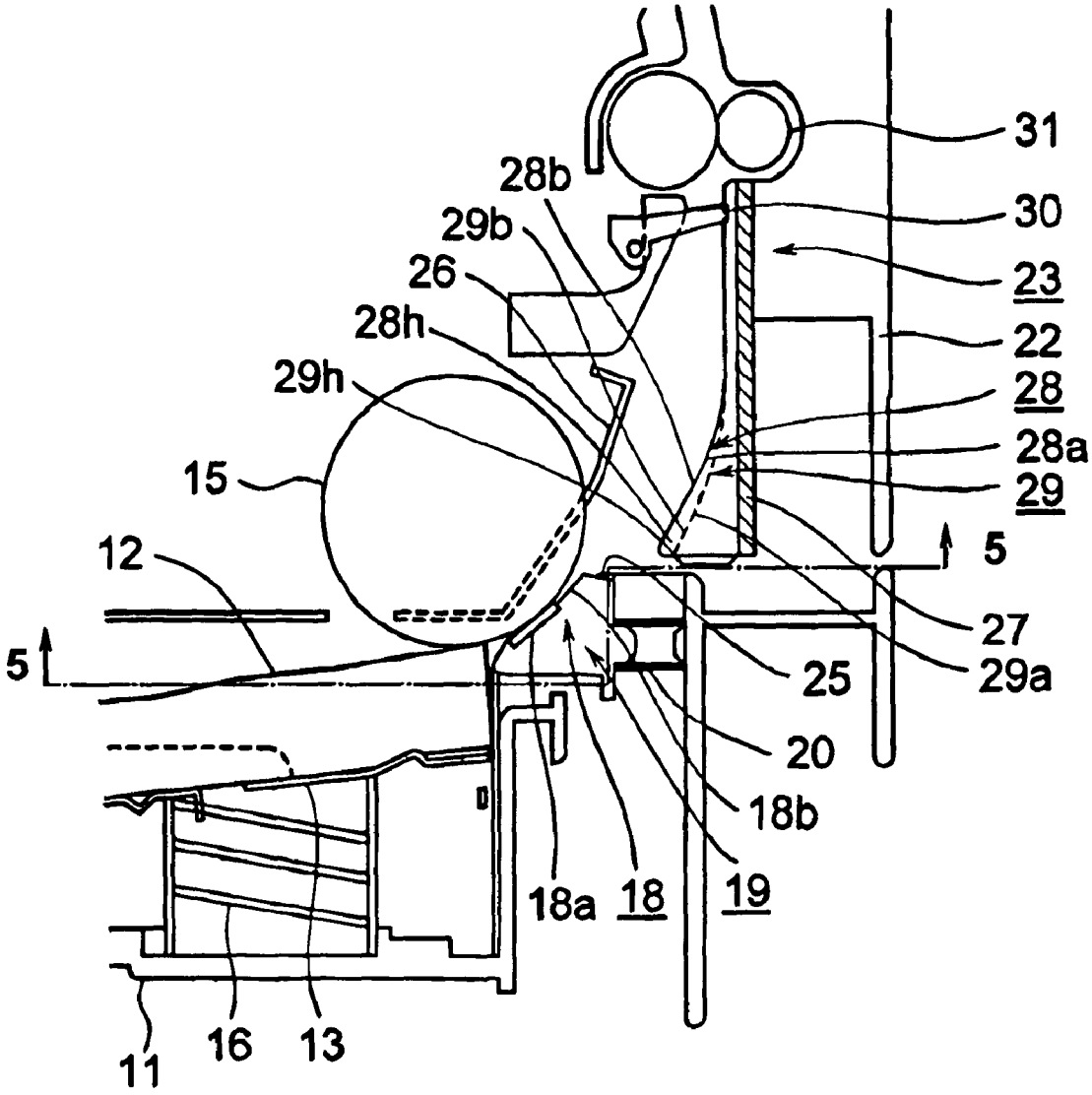
FIG. 1 is a schematic sectional view showing a sheet supply cassette according to a first embodiment of the present invention.
Figure 3:
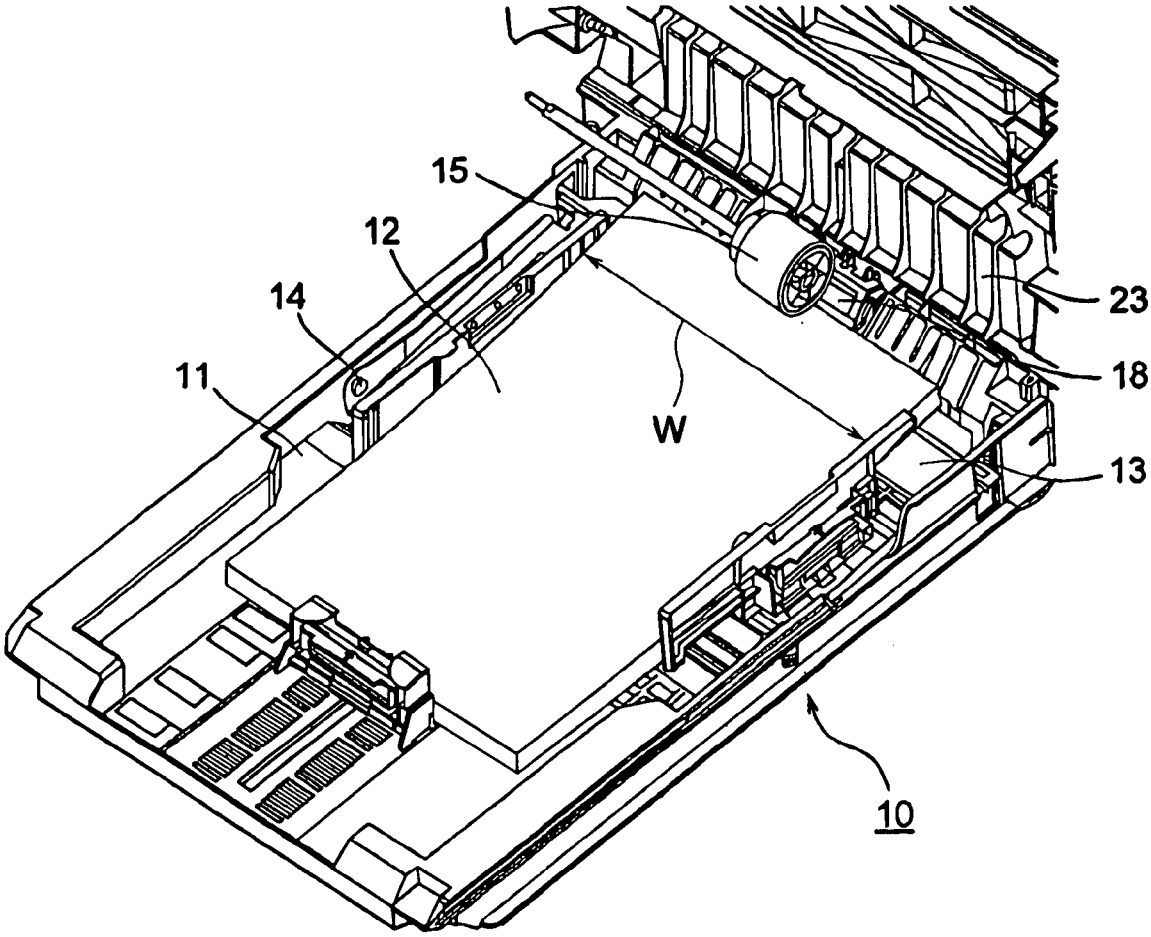
FIG. 3 is a diagonal view showing a sheet supply unit according to the first embodiment of the present invention.
Figure 4:
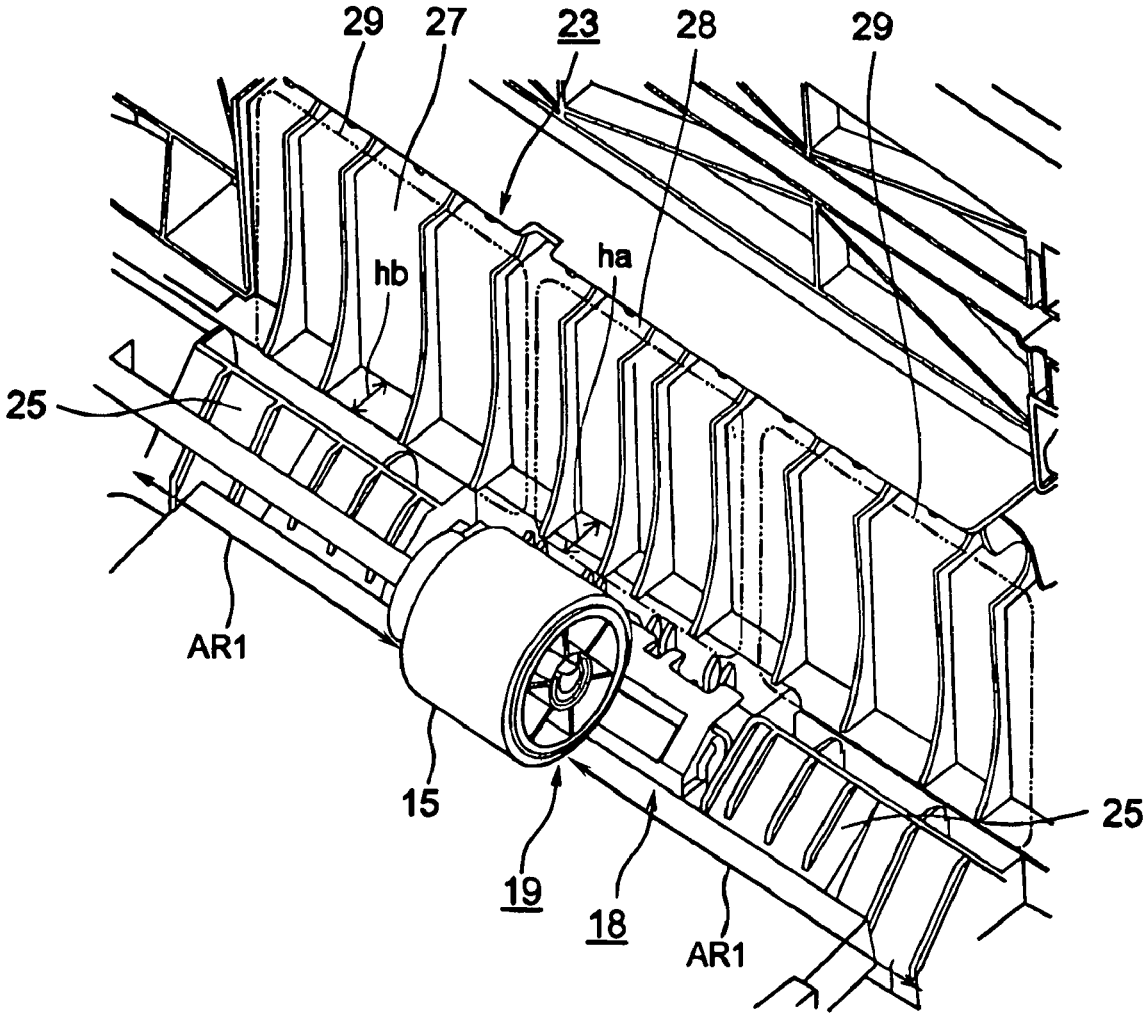
FIG. 4 is an enlarged view showing the sheet supply unit according to the first embodiment of the present invention.
Figure 5:
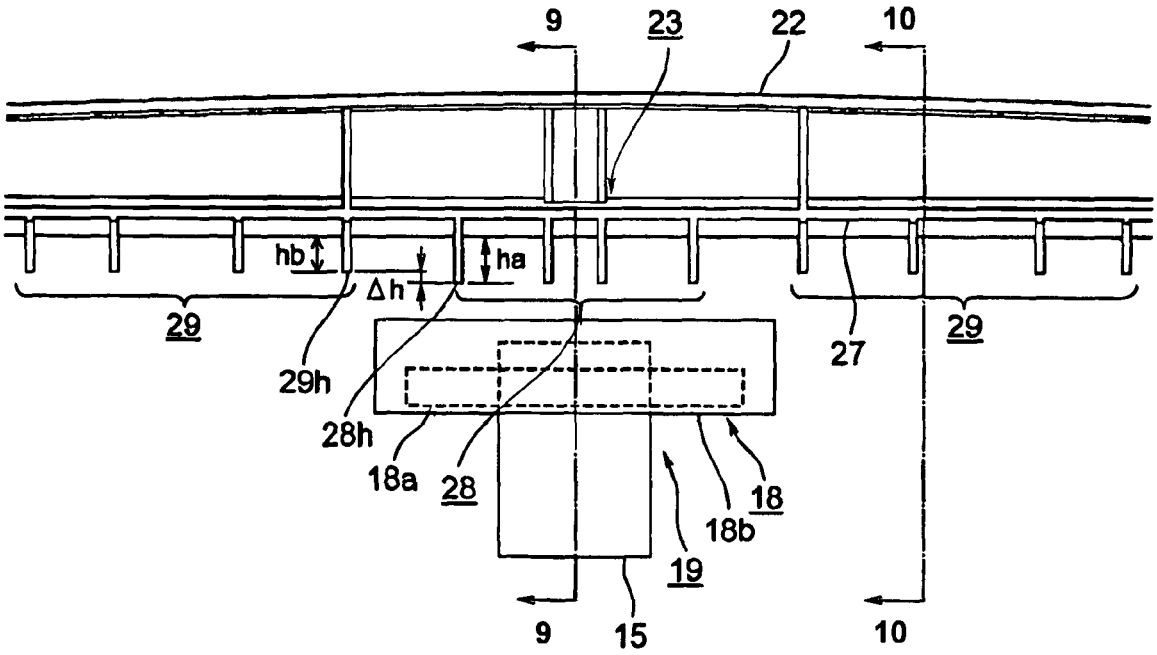
FIG. 5 is a sectional view taken along a line 5-5 in FIG. 1 according to the first embodiment of the present invention.

FIG. 1 is a schematic sectional view showing the sheet supply cassette 11 according to the first embodiment of the present invention. FIG. 3 is a diagonal view showing the sheet supply unit 11 according to the first embodiment of the present invention. FIG. 4 is an enlarged view showing the sheet supply unit 11 according to the first embodiment of the present invention. FIG. 5 is a sectional view taken along a line 5-5 in FIG. 1 according to the first embodiment of the present invention As shown in FIGS. 3 and 4, a transport section 19 formed of the sheet supply roller 15 and the separation member 18 is arranged at a center portion of the sheet supply cassette 11 in a width direction thereof or a width W of the sheet 12. Accordingly, left and right side areas AR1 are formed on left and right sides of the sheet supply roller 15 from end portions of the sheet supply roller 15 to both edge portions of the sheet supply cassette 11. A guide member 25 as a lower guide member and a first guide member is disposed in each of the side areas AR1 on each side of the separation member 18 for guiding the sheet 12 at a lower side. A guide member 26 facing the guide member 25 as an upper guide member and a second guide member is disposed in each of the side areas AR1 on each side of the separation member 18 for guiding the sheet 12 at an upper side.

Further, a guide member 23 as a third guide member or a downstream side guide member extending upward is disposed on a downstream side of the sheet supply roller 15 and the guide members 25 in the transport direction of the sheet 12 for guiding the sheet 12 toward the downstream side.

In the embodiment, the sheet supply roller 15 and the separation member 18 transport the sheet 12 obliquely upward. When the front edge of the sheet 12 abuts against the guide member 23, the sheet 12 is curved in a substantially L character shape. Note that a medium transport device is formed of the sheet supply roller 15, the separation member 18, the guide member 23, the guide members 25, the guide members 26, a medium sensor 30, the transport rollers 31, and the like.

When the sheet 12 is transported, the front edge of the sheet 12 moves in different ways between a portion close to the sheet supply roller 15 and both side portions or portions in the side areas AR1. Accordingly, the guide member 23 has a shape corresponding to the different movements of the front edge of the sheet 12. In particular, the guide member 23 has a shape for guiding a center portion of the sheet 12 different from that for guiding portions of the sheet 12 other than the center portion.

In the embodiment, the guide member 23 includes a base portion 27 and a plurality of first and second rib portions 28 and 29 protruding from the base portion 27 toward a transport path of the sheet 12. The first rib portions 28 are disposed at a center portion of the guide member 23, i.e., a corresponding portion corresponding to the transport section 19 on a downstream side of the separation member 18. The second rib portions 29 are disposed on a downstream side of the guide members 25. Note that, in FIGS. 4 and 5, the reference numerals 28 and 29 represent a group of the rib portions, rather than each rib portion.

In the embodiment, the first rib portions 28 and the second rib portions 29 have heights from the base portion 27 thereof to guide surfaces 28*b* and 29*b* for guiding the sheet 12 (distal end edges), and the heights increase along a quadratic function curve from a lower end to an upper end. Accordingly, the sheet 12 abuts against the guide surfaces 28*b* and 29*b* at a small relative angle or a small entry angle. Further, the first rib portions 28 have a height from the base portion 27 thereof to the guide surfaces 28*b* at curved portions 28*a* larger than a height of the second rib portions 29 from the base portion 27 thereof to the guide surfaces 29*b* at curved portions 29*a*. Still further, as shown in FIG. 1, a difference of the heights of the first rib portions 28 and the second rib portions 29 does not exist at the upper end and increases toward a lower side.

As shown in FIGS. 4 and 5, a maximum height ha of the first rib portions 28 from the base portion 27 to peaks 28*h* is larger than a maximum height hb of the second rib portions 29 from the base portion 27 to peaks 29*h*. In FIG. 5, a Δh represents a difference between the maximum height ha and the maximum height hb. In the embodiment, positions of the peaks 29*h* of the second rib portions 29 in a vertical direction are situated at a height lower than that of positions of the peaks 28*h* of the first rib portions 28 in the vertical direction.

In the embodiment, as shown in FIG. 1, the medium sensor 30 and the transport rollers 31 are disposed on a downstream side of the guide member 23 in the transport direction of the sheet 12. The separation member 18 includes a separation pad 18*a* and a supporting member 18*b* for supporting the separation pad 18*a*. Further, the sheet supply cassette 11 is provided with the pushing spring 16 and the pressing member 20. The outer housing 22 is disposed in an outer housing of the printer.

An operation of the sheet supply unit 10 will be explained next. First, when a sheet supply motor (not shown) as a drive unit for transporting a medium is driven to rotate the sheet supply roller 15 at a constant speed, the sheet 12 at the uppermost position placed on the medium placing base 13 is drawn from the medium placing base 13. At this time, the front edge of the sheet 12 is transported to a nip portion of the sheet supply roller 15 and the separation member 18, so that the sheet supply roller 15 and the separation member 18 sandwich the sheet 12, thereby transporting the sheet 12 one by one.

Figure 6:
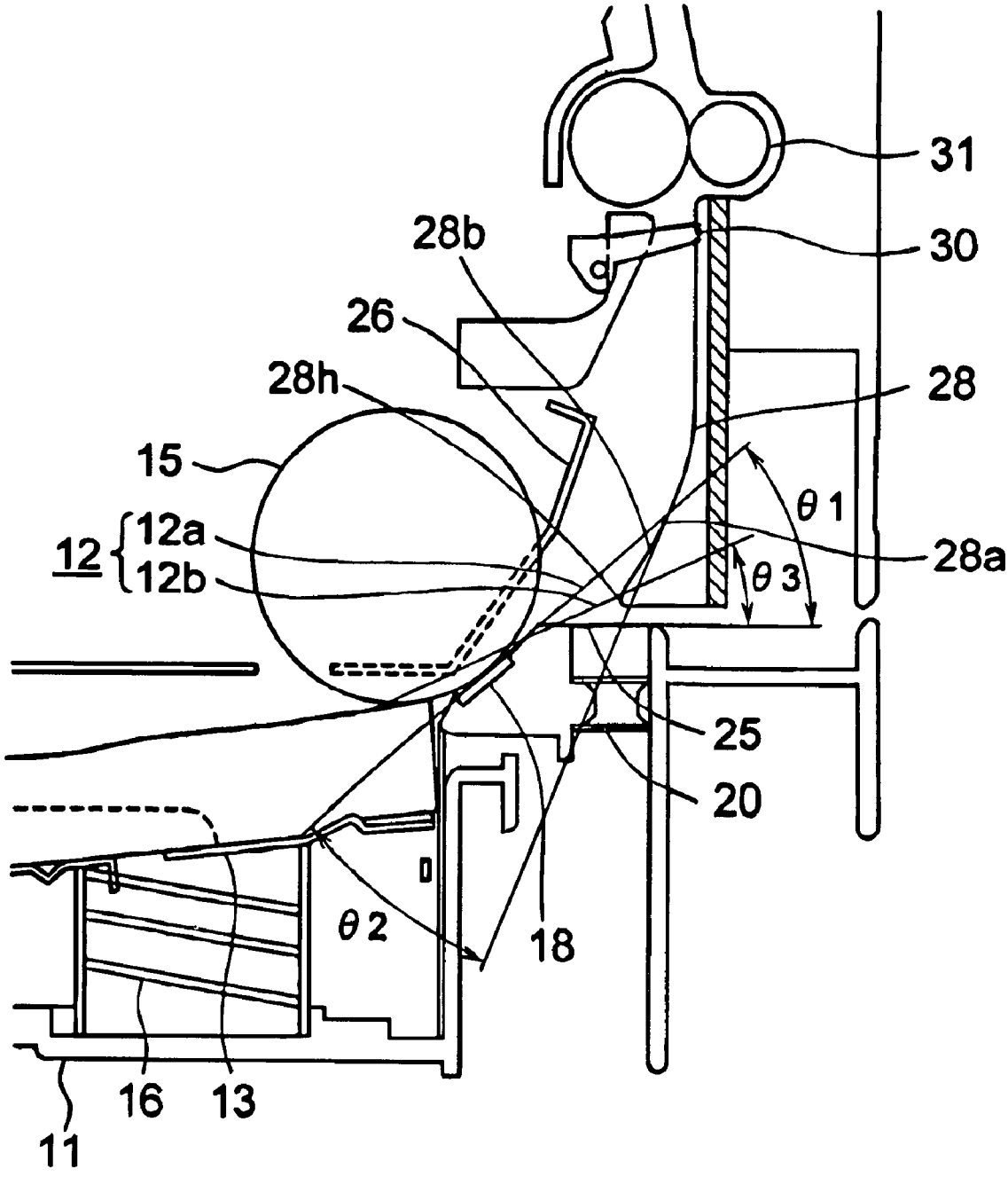
FIG. 6 is a schematic reference view No. 1 showing a state that a medium is transported.

When only the first rib portions 28 are arranged over the width direction of the sheet supply unit 10 without the second rib portions 29, the sheet 12 is transported in the following way. FIG. 6 is a schematic reference view No. 1 showing a state that the sheet 12 is transported. After the sheet 12 is drawn with the sheet supply roller 15, a portion 12*a* of the sheet 12 near the sheet supply roller 15 is sandwiched with the sheet supply roller 15 and the separation member 18. Accordingly, the portion 12*a* of the sheet 12 is transported in a state inclined by an angle θ1 relative to a horizontal direction, and abut against the first rib portions 28 with an angle θ2.

In contrast, portions 12*b* of the sheet 12 in the side areas AR1 are not sandwiched with the sheet supply roller 15 and the separation member 18, thereby receiving no positional restriction. Accordingly, when the sheet 12 is transported, front edges of the portions 12*b* are situated below a front edge of the portion 12*a*. As a result, the portions 12*b* of the sheet 12 contact with the guide members 25 and are transported toward the first rib portions 28 in a state inclined by an angle θ3 relative to a horizontal direction. In this case, the portions 12*b* in the side areas AR1 are transported in a state inclined by the angle θ3, so that the portions 12*b* may be caught with the peaks 28*h* of the first rib portions 28.

Figure 7:
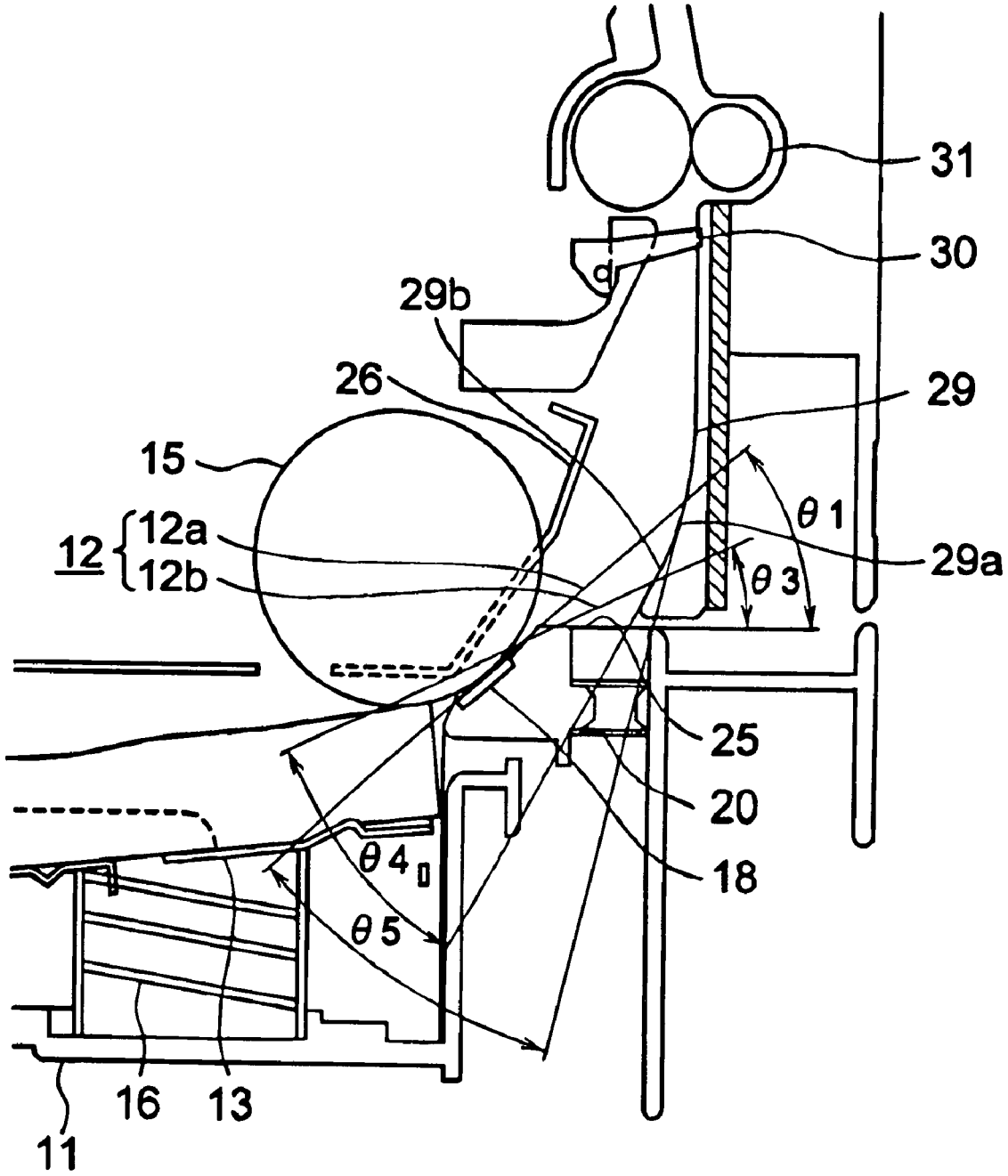
FIG. 7 is a schematic reference view No. 2 showing another state that the medium is transported.

When only the second rib portions 29 are arranged over the width direction of the sheet supply unit 10 without the first rib portions 28, the sheet 12 is transported in the following way. FIG. 7 is a schematic reference view No. 2 showing another state that the sheet 12 is transported.

After the sheet 12 is drawn with the sheet supply roller 15, the portion 12*a* of the sheet 12 near the sheet supply roller 15 is sandwiched with the sheet supply roller 15 and the separation member 18. Accordingly, the portion 12*a* of the sheet 12 is transported in a state inclined by the angle θ1 relative to a horizontal direction, and abut against the second rib portions 29 with an angle θ5.

In contrast, the portions 12*b* of the sheet 12 in the side areas AR1 are transported along the guide members 25 after abutting against the guide members 25. After passing the guide members 25 while contacting with the guide members 26, the portions 12*b* of the sheet 12 are transported in a state inclined by an angle θ3 relative to a horizontal direction, and abut against the second rib portions 29 with an angle θ4.

As described above, the second rib portions 29 are situated below the first rib portions 28. Accordingly, the front edges of the portions 12*b* in the side areas AR1 abut against the second rib portions 29 at portions above the peaks 29*h*, not against the peaks 29*h* of the second rib portions 29. In contrast, the front edge of the portion 12*a* near the sheet supply roller 15 abuts against the second rib portions 29 at portions above portions of the first rib portions 28 where the front edge of the portion 12*a* abuts against as shown in FIG. 6.

Accordingly, the front edge of the portion 12*a* near the sheet supply roller 15 abuts against the second rib portions 29 with the angle θ5 larger than the angle θ2 with which the front edge of the portion 12*a* abuts against the first rib portions 28 in FIG. 6. When the front edge of the sheet 12 abuts against the second rib portions 29 with a large angle, the front edge of the sheet 12 abuts against the second rib portions 29 with a large reaction force therefrom, so that the front edge of the sheet 12 tends to bend easily.

Figure 8:
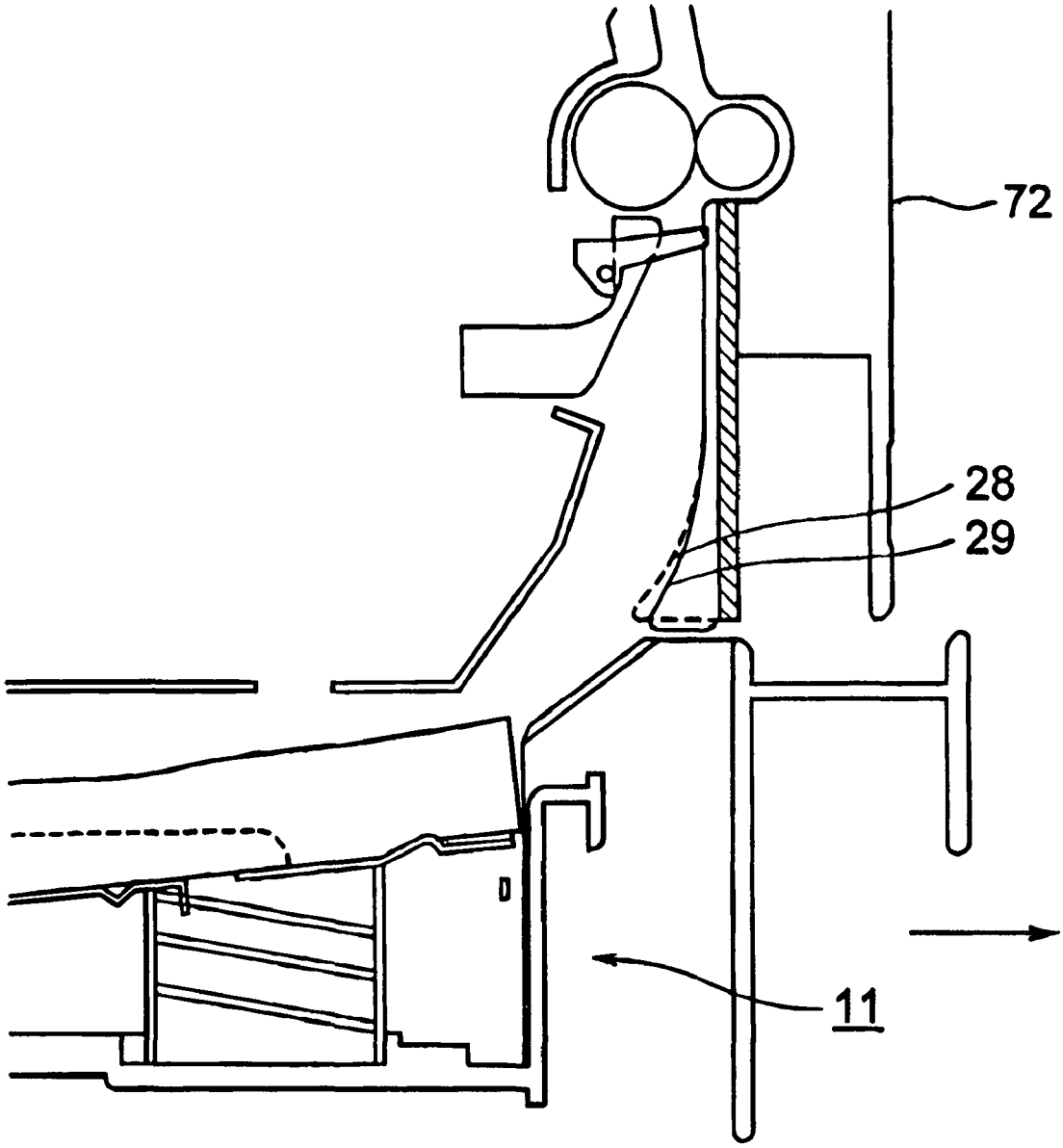
FIG. 8 is a schematic sectional view showing the sheet supply cassette in a withdrawn state according to the first embodiment of the present invention.

FIG. 8 is a schematic sectional view showing the sheet supply cassette 11 in a withdrawn state according to the first embodiment of the present invention. As shown in FIG. 8, when the sheet supply cassette 11 is withdrawn from the apparatus main body 72, the first rib portions 28 and the second rib portions 29 are situated above a moving portion of the sheet supply cassette 11 (upper side in FIG. 8). Accordingly, when the sheet supply cassette 11 is attached or detached, the sheet supply cassette 11 does not interfere with the first rib portions 28 and the second rib portions 29.

Figure 9:
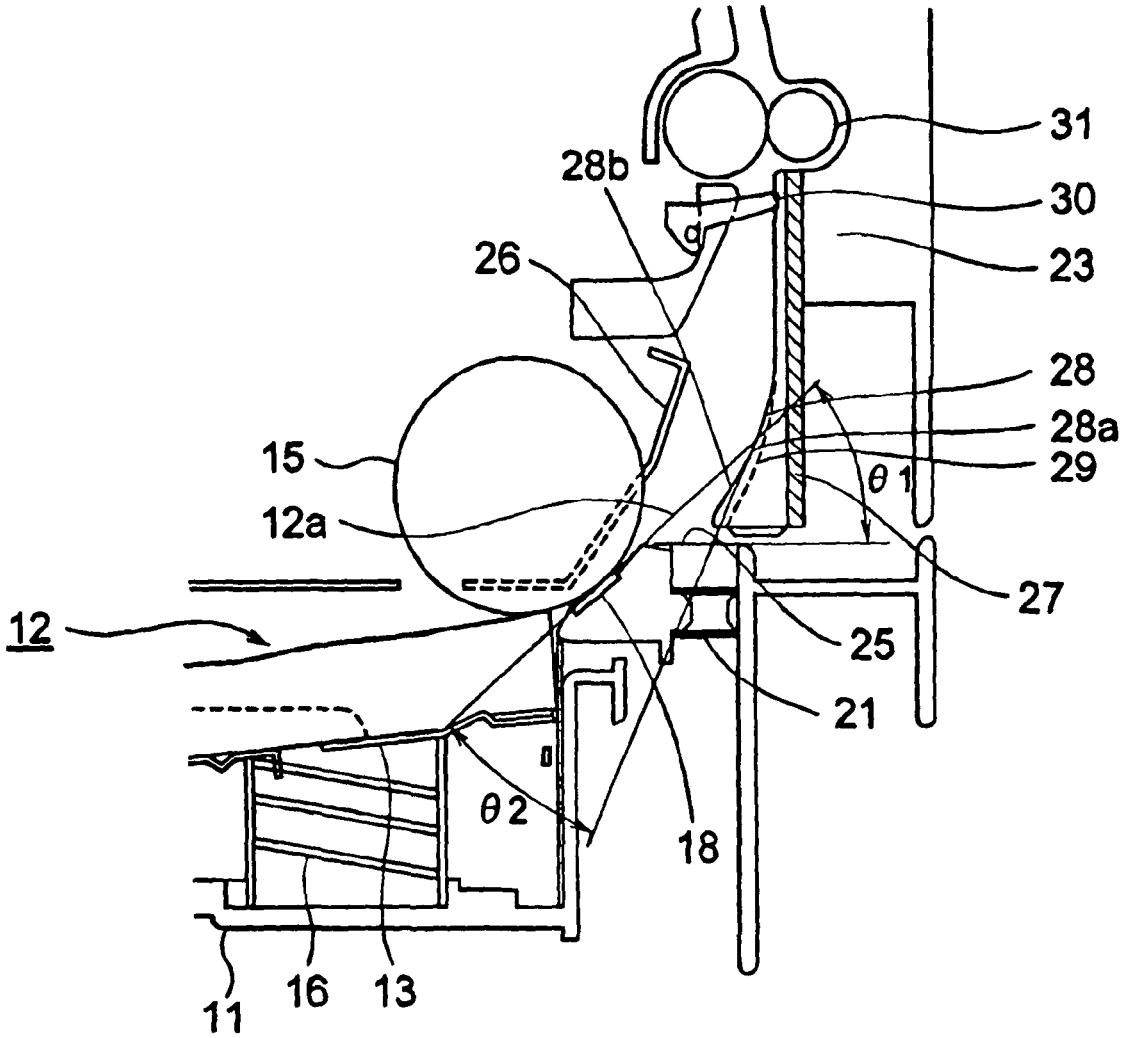
FIG. 9 is a schematic view No. 1 showing the sheet supply unit during an operation thereof according to the first embodiment of the present invention.
Figure 10:
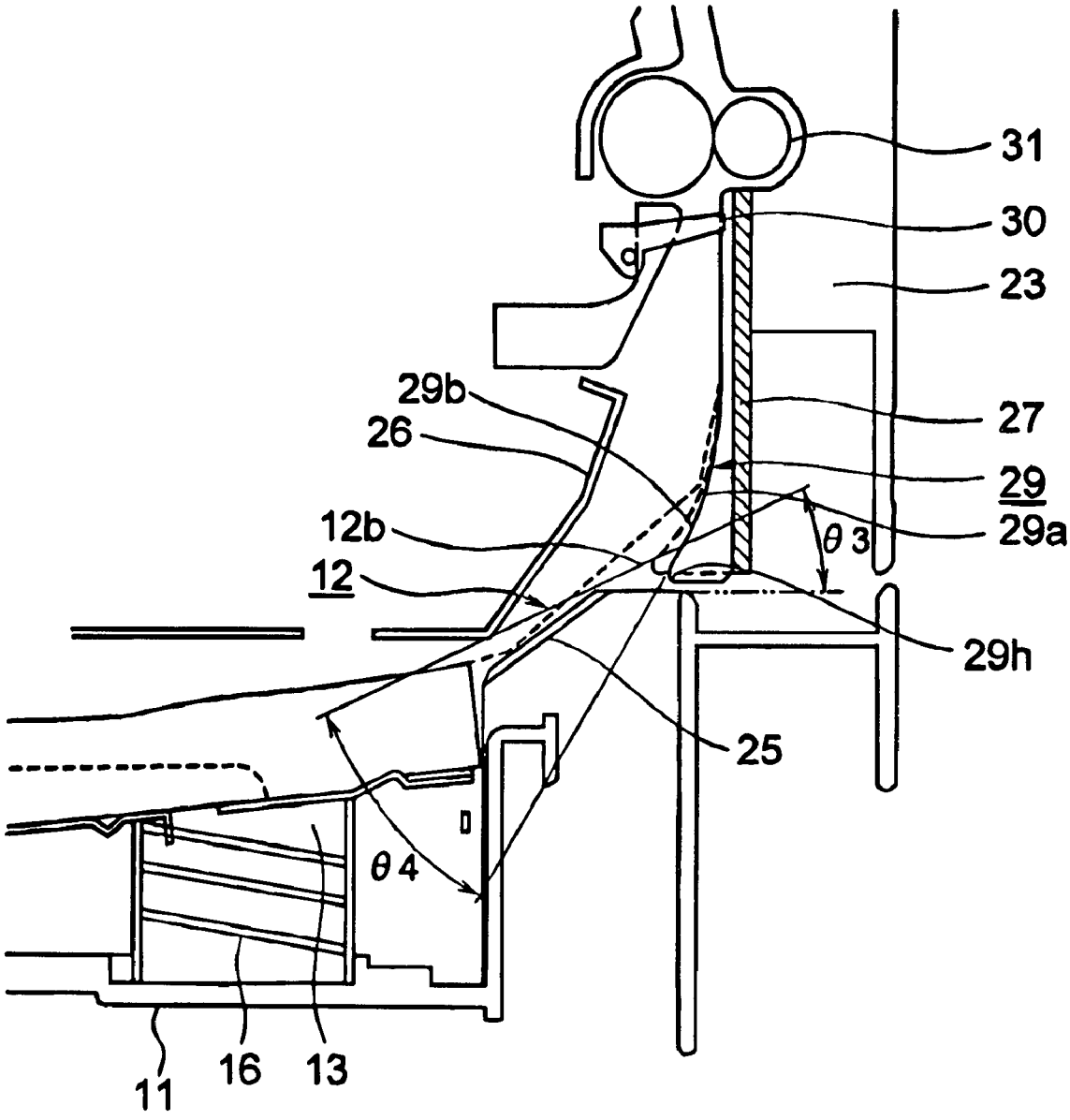
FIG. 10 is a schematic view No. 2 showing the sheet supply unit during the operation thereof according to the first embodiment of the present invention.

FIG. 9 is a schematic view No. 1 showing the sheet supply unit 10 during an operation thereof according to the first embodiment of the present invention. FIG. 10 is a schematic view No. 2 showing the sheet supply unit 10 during the operation thereof according to the first embodiment of the present invention. FIG. 9 is a sectional view taken along a line 9-9 in FIG. 5, and FIG. 10 is a sectional view taken along a line 10-10 in FIG. 5.

After the sheet supply roller 15 and the separation member 18 separate the sheet 12 into one sheet, as shown in FIG. 9, the sheet 12 is transported with the portion 12*a* of the sheet 12 near the sheet supply roller 15 inclined by the angle θ1 relative to the horizontal direction, and the portion 12*a* of the sheet 12 abuts against the first rib portions 28 with the angle θ2. Afterward, the portion 12*a* of the sheet 12 is transported along the first rib portions 28, and passes through the medium sensor 30 before moving toward the transport rollers 31.

As shown in FIG. 10, the portions 12*b* of the sheet 12 in the side areas AR1 (refer to FIG. 4) abut against the guide members 25 and are transported along the guide members 25. After the portions 12*b* of the sheet 12 pass through the guide members 25 while contacting with the guide members 26, the portions 12*b* of the sheet 12 abut against the second rib portions 29 disposed on the guide member 23. At this moment, the sheet 12 is transported in a state inclined by the angle θ3 relative to the horizontal direction, and the front edge of the sheet 12 abuts against the second rib portions 29 with an angle 84. Afterward, the sheet 12 is transported along the second rib portions 29, and passes through the medium sensor 30 before moving toward the transport rollers 31.

In the embodiment, the first rib portions 28 have heights in the direction that the sheet is transported and in the vertical direction same as that of the second rib portions 29 at the upper ends of the first rib portions 28 and the second rib portions 29 near the pair of the transport rollers 31. Accordingly, when the pair of the transport rollers 31 transports the sheet 12, the sheet 12 does not wave in the direction that the sheet is transported and in the vertical direction.

In the embodiment, it is preferably arranged such that the front edge of the sheet 12 abuts against the first rib portions 28 with the angle θ2 and against the second rib portions 29 with the angle θ4 in the following ranges.

$$0° < \theta 2 < 45°$$

$$0° < \theta 4 < 45°$$

In the embodiment, the positions of the peaks 29*h* of the second rib portions 29 in the vertical direction are situated at a height lower than that of the positions of the peaks 28*h* of the first rib portions 28 in the vertical direction. Accordingly, when the sheet 12 is transported in the state that the portions 12*b* of the sheet 12 in the side areas AR1 are situated below the portion 12*a* of the sheet 12 in the vertical direction, the second rib portions 29 can securely guide the portions 12*b* transported at a height lower than the portion 12*a*.

In the embodiment, a control unit (not shown) drives a drive unit (not shown) to rotate the transport rollers 31 at a timing when the sheet 12 passes through the medium sensor 30 (or the front edge of the sheet 12 reaches the medium sensor 30), thereby transporting the sheet 12. In general, the transport rollers 31 are controlled not to start rotating for a specific period of time after the sheet 12 passes through the medium sensor 30, so that the sheet 12 is pushed into the transport rollers 31 to correct skew thereof.

After the sheet 12 is out from the transport rollers 31, the sheet 12 is transported to the transport rollers 70. The transport rollers 70 transport the sheet 12 to the transfer transport belt unit 50. In the transfer transport belt unit 50, the transfer roller 52 presses the transport belt 51 against the photosensitive drum 41, so that the toner image formed on the photosensitive drum 41 is transferred to the sheet 12 on the transport belt 51. Afterward, the fixing roller 61 and the pressing roller 62, controlled at a pressing temperature, heat and press the toner image unfixed on the sheet 12, so that the toner image is fixed to the sheet 12, thereby forming an image. Then, the transport rollers 71 transport and discharge the sheet 12 to the medium placing portion 73 in a state that a surface of the sheet 12 with the image formed thereon faces downward.

As described above, in the embodiment, when the sheet supply roller 15 pulls out the sheet 12, the portion 12*a* of the sheet 12 abuts against the first rib portions 28 and is situated below the portions 12*b* of the sheet 12 in the side areas AR1. Accordingly, the sheet 12 is not caught with the second rib portions 29. As a result, it is possible to prevent a transport jam and bending of the sheet 12 without increasing an angle with which the portion 12*a* of the sheet 12 abuts against the first rib portions 28, thereby accurately and securely transporting the sheet 12.

Second Embodiment

A second embodiment of the invention will be described below. Components in the second embodiment similar to those in the first embodiment are designated by the same reference numerals, and explanations thereof are omitted. The components in the second embodiment similar to those in the first embodiment provide effects similar to those in the first embodiment.

Figure 11:
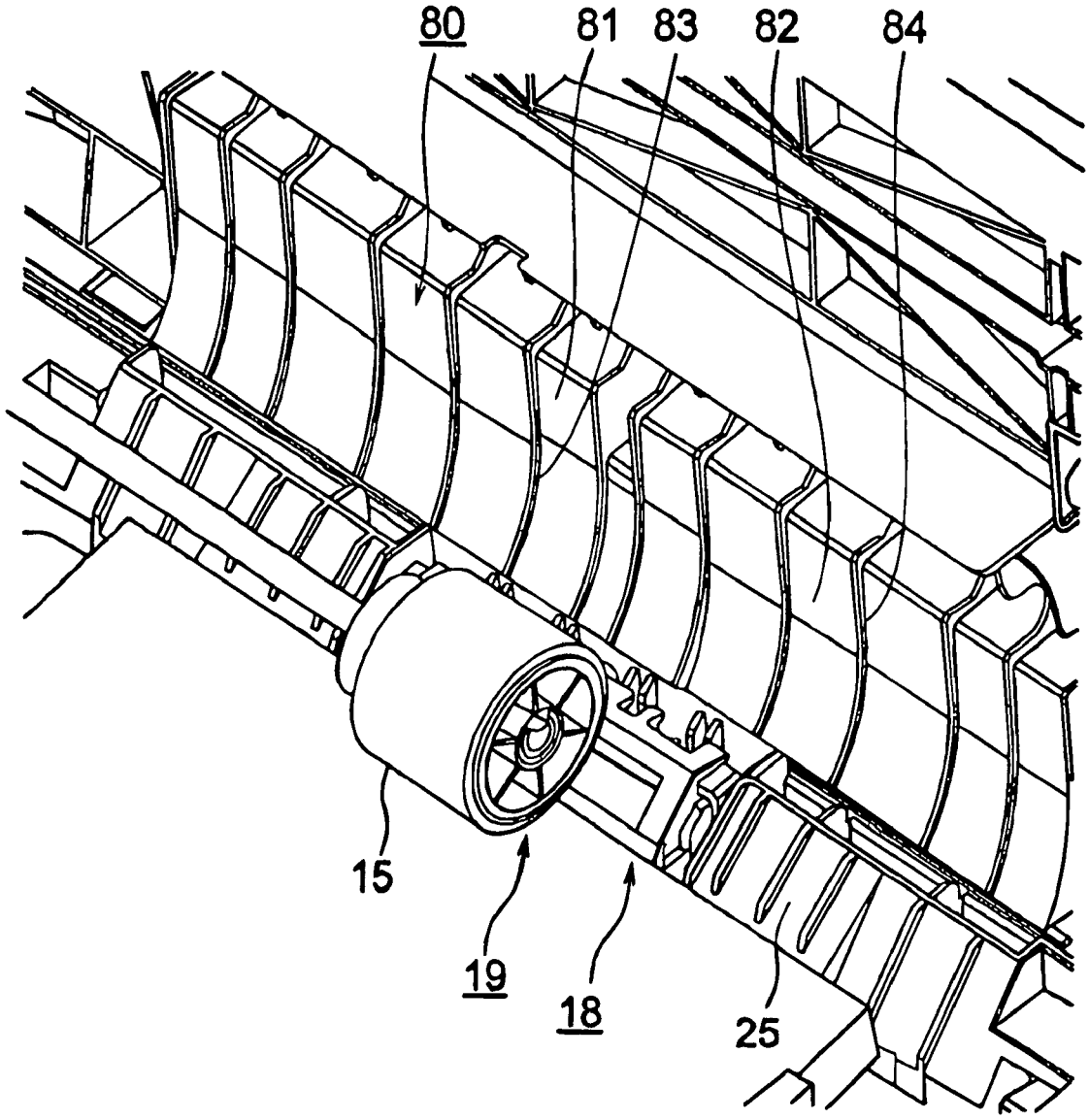
FIG. 11 is a schematic sectional view showing a sheet supply unit according to a second embodiment of the present invention.
Figure 12:
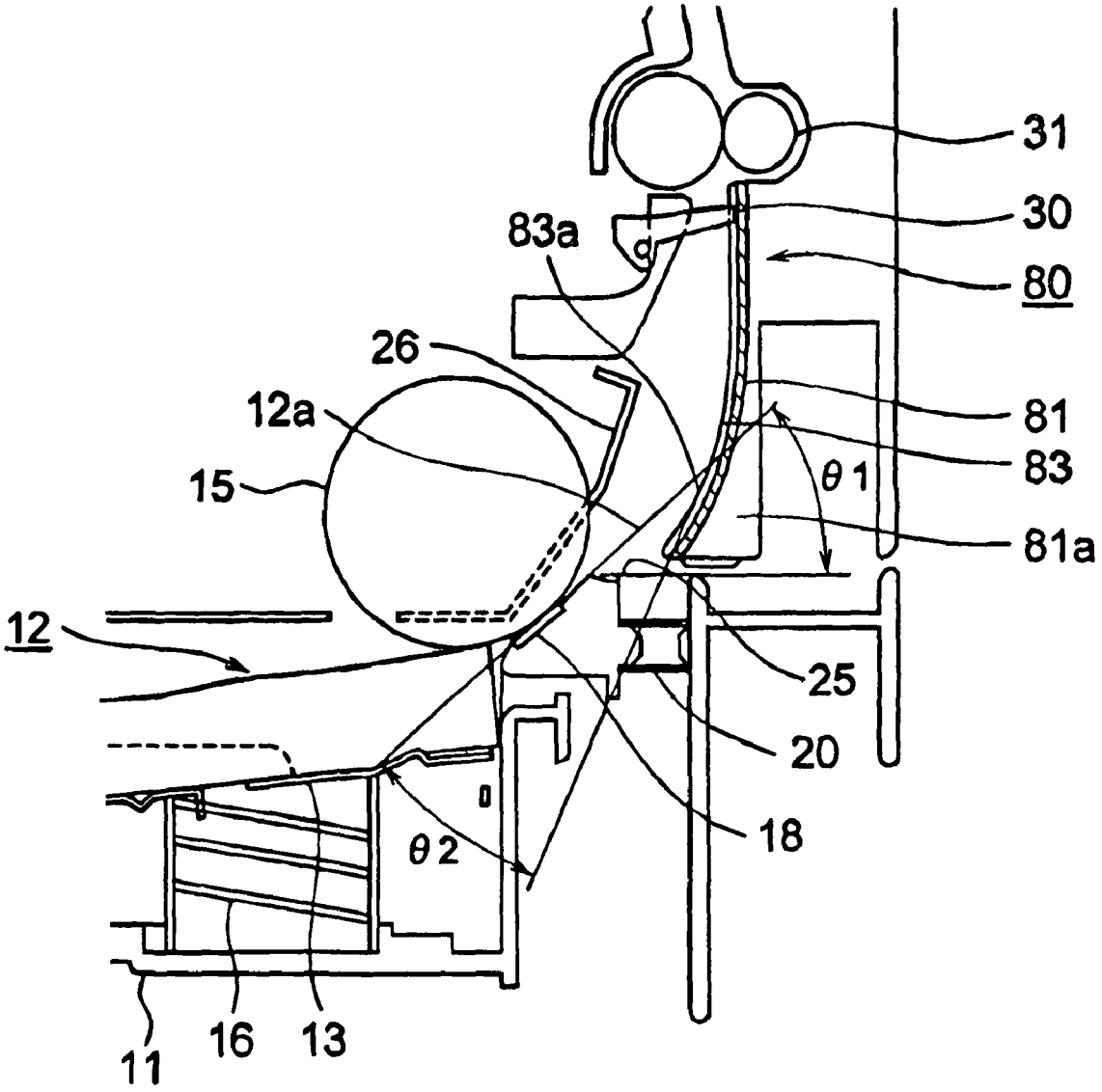
FIG. 12 is a schematic view No. 1 showing the sheet supply unit during an operation thereof according to the second embodiment of the present invention.
Figure 13:
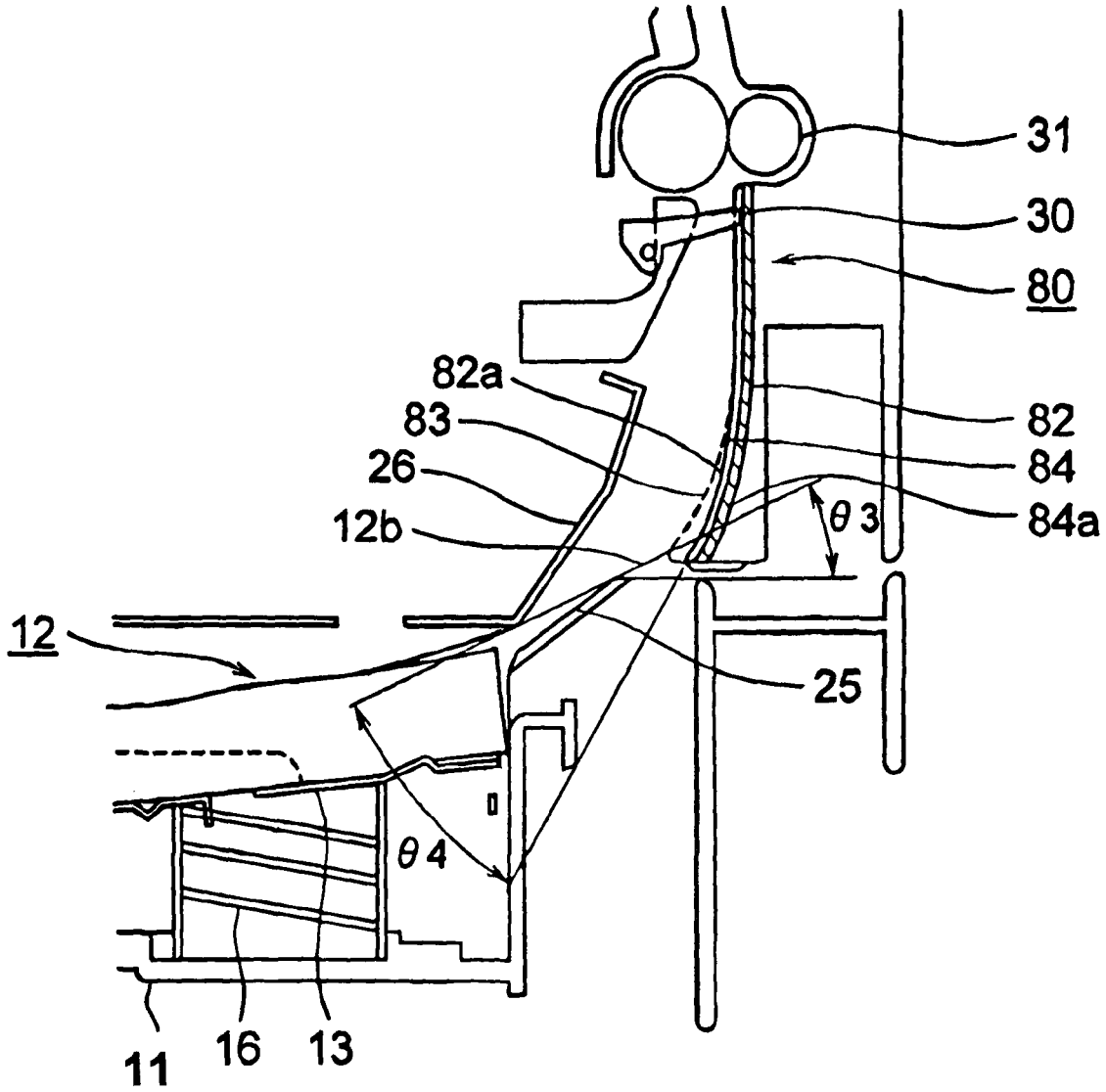
FIG. 13 is a schematic view No. 2 showing the sheet supply unit during the operation thereof according to the second embodiment of the present invention.

FIG. 11 is a schematic sectional view showing the sheet supply unit 10 according to the second embodiment of the present invention. FIG. 12 is a schematic view No. 1 showing the sheet supply unit 10 during an operation thereof according to the second embodiment of the present invention. FIG. 13 is a schematic view No. 2 showing the sheet supply unit 10 during the operation thereof according to the second embodiment of the present invention.

In the embodiment, the sheet supply unit 10 is provided with the sheet supply roller 15 and the guide members 25 as a drawing member and the transport member in the transport direction of the sheet 12 as a medium. A guide member 80 is disposed on a downstream side of the sheet supply roller 15 and the guide members 25 for guiding the sheet 12 toward the downstream side.

In the embodiment, the guide member 80 includes a first base portion 81; a second base portion 82; a plurality of first rib portions 83 extending from the first base portion 81 by a specific length (for example, 1.5 mm); and a plurality of second rib portions 84 extending from the second base portion 82 by a specific length (for example, 1.5 mm). The first base portion 81 and the first rib portions 83 are disposed at a center portion of the guide member 80. The second base portion 82 and the second rib portions 84 are disposed on a downstream side of the guide members 25.

In the embodiment, the first base portion 81 and the second base portion 82 have curved portions 81*a* and 82*a* with heights increasing along a quadratic function curve, respectively. Further, the first base portion 81 is situated above the second base portion 82. Still further, the first rib portions 83 include guide surfaces 83*a* situated above guide surfaces 84*a* of the second rib portions 84 (toward the guide members 26).

As described above, in the embodiment, the first base portion 81 is situated above the second base portion 82 (toward the guide members 26). Further, the first base portion 81 and the second base portion 82 have the first rib portions 81 and the second rib portions 82 having a height of 1.5 mm, respectively. Alternatively, the first base portion 81 may be situated above the second base portion 82 (toward the guide members 26), and the first base portion 81 may have the rib portions 81 having a height of 2.0 mm and the second base portion 82 may have the rib portions 82 having a height of 1.5 mm, respectively. Accordingly, the height of the first rib portions 83 is different from that of the second rib portions 84, and the guide surfaces 83*a* are situated above the guide surfaces 84*a* (toward the guide members 26).

An operation of the sheet supply unit 10 will be explained next. After the sheet supply roller 15 and the separation member 18 separate the sheet 12 into one sheet, as shown in FIG. 12, the sheet 12 is transported with the portion 12*a* of the sheet 12 near the sheet supply roller 15 inclined by the angle θ1 relative to the horizontal direction, and the portion 12*a* of the sheet 12 abuts against the first rib portions 83 with the angle θ2. Afterward, the portion 12*a* of the sheet 12 is transported along the first rib portions 83, and passes through the medium sensor 30 before moving toward the transport rollers 31.

As shown in FIG. 13, the portions 12*b* of the sheet 12 in the side areas AR1 abut against the guide members 25 and are transported along the guide members 25. After the portions 12*b* of the sheet 12 pass through the guide members 25 while contacting with the guide members 26, the portions 12*b* of the sheet 12 abut against the second rib portions 84 disposed on the guide member 80. At this moment, the sheet 12 is transported in a state inclined by the angle θ3 relative to the horizontal direction, and the front edge of the sheet 12 abuts against the second rib portions 84 with the angle θ4. Afterward, the sheet 12 is transported along the second rib portions 84, and passes through the medium sensor 30 before moving toward the transport rollers 31.

As described above, the first rib portions 83 and the second rib portions 84 protrude from the first base portion 81 and the second base portion 82 by a specific length, respectively. Accordingly, when the portions 12*b* of the sheet 12 are curled toward the second base portion 82, the second base portion 82 guides the portions 12*b*, thereby accurately and securely transporting the sheet 12.

Third Embodiment

A third embodiment of the present invention will be described below. Components in the third embodiment similar to those in the first and second embodiments are designated by the same reference numerals, and explanations thereof are omitted. The components in the third embodiment similar to those in the first and second embodiments provide effects similar to those in the first and second embodiments.

Figure 14:
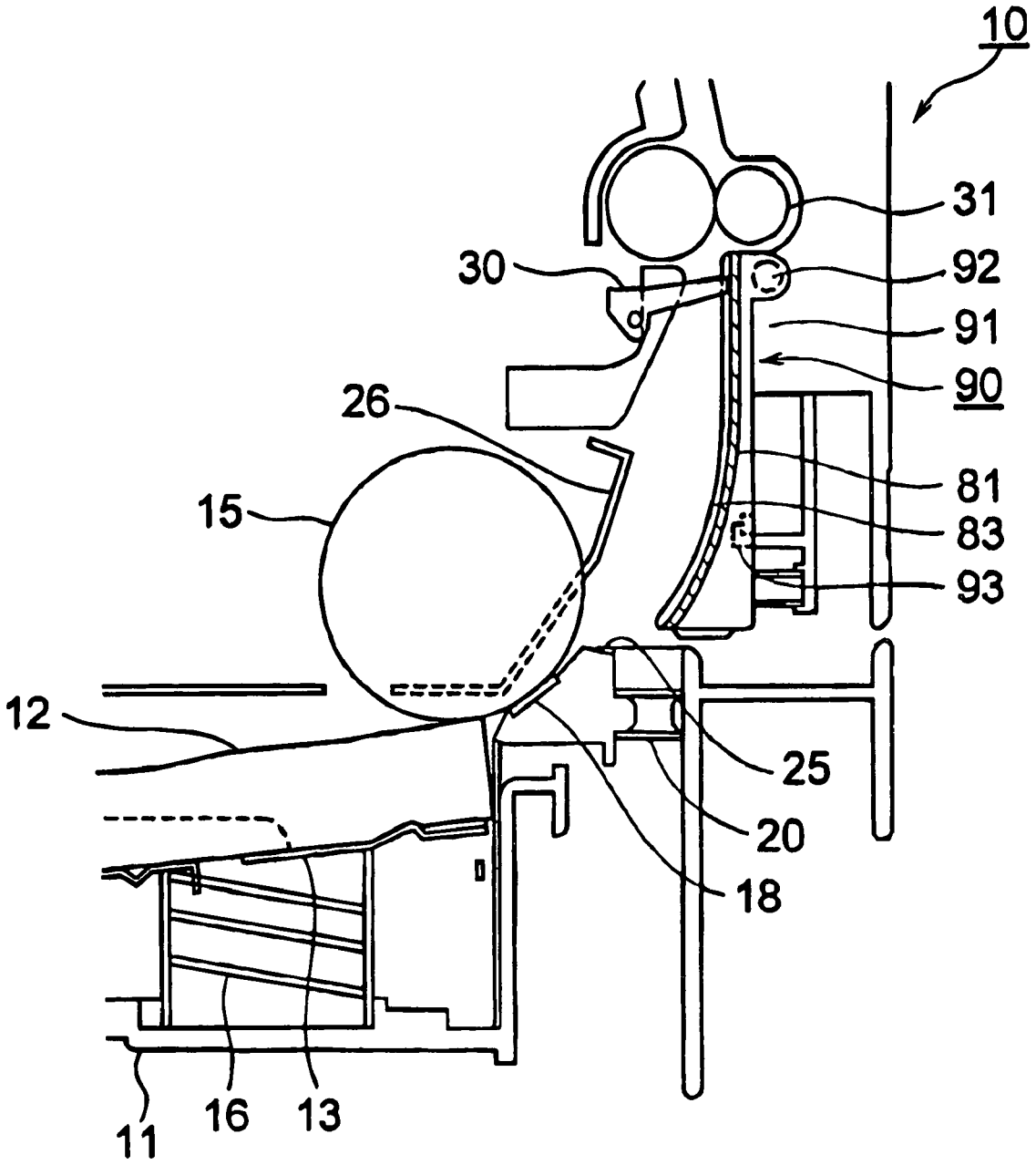
FIG. 14 is a schematic sectional view showing a sheet supply unit according to a third embodiment of the present invention.

FIG. 14 is a schematic sectional view showing the sheet supply unit 10 according to the third embodiment of the present invention.

In the embodiment, the sheet supply unit 10 is provided with a first guide member 90 and a second guide member 91 disposed on a downstream side of the sheet supply roller 15 and the guide members 25 in the transport direction of the sheet 12 for guiding the sheet 12 toward the downstream side.

In the embodiment, the first guide member 90 includes the first base portion 81 and a plurality of the first rib portions 83 extending from the first base portion 81 by a specific length, and the second guide member 91 includes a second base portion (not shown) and a plurality of second rib portions (not shown) extending from the second base portion by a specific length. The first guide member 90 is disposed on a downstream side of the separation member 18, and the second guide member 91 is disposed on a downstream side of the guide members 25.

In the embodiment, the first guide member 90 is supported on a shaft portion 92 extending from both sides of an upper edge thereof to be freely rotatable around the shaft portion 92 relative to the second guide member 91. Further, an urging member (not shown) urges the first guide member 90 toward the sheet supply roller 15, so that the first guide member 90 abuts against a stopper portion 93 of the second guide member 91 for regulating a front position thereof.

Figure 15:
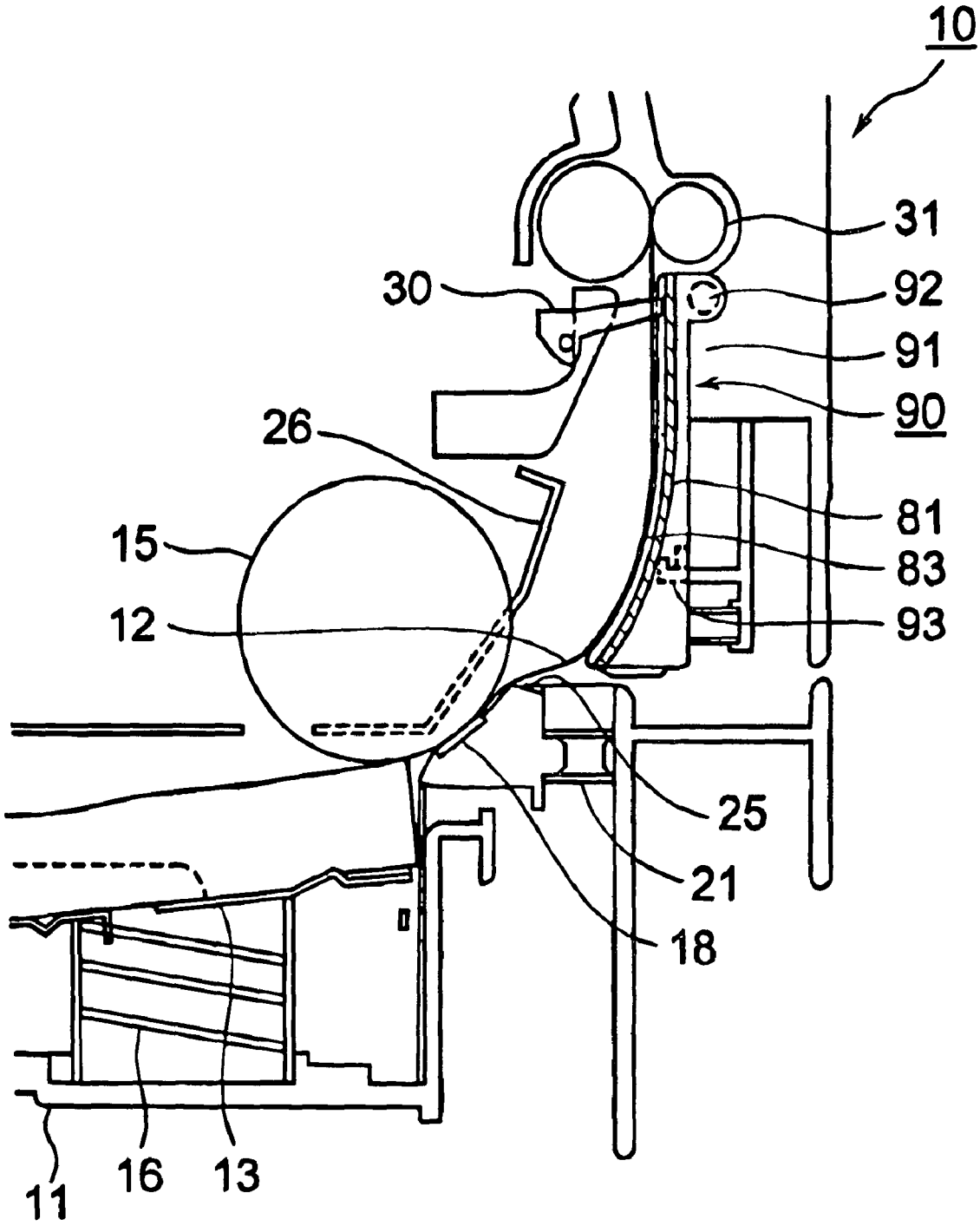
FIG. 15 is a schematic view showing the sheet supply unit during an operation thereof according to the third embodiment of the present invention.

An operation of the sheet supply unit 10 will be explained next. FIG. 15 is a schematic view showing the sheet supply unit 10 during an operation thereof according to the third embodiment of the present invention. After the sheet supply roller 15 and the separation member 18 separate the sheet 12 into one sheet, the portion 12*a* of the sheet 12 near the sheet supply roller 15 abuts against the first rib portions 83 of the first guide member 90. At this moment, even though the portion 12*a* of the sheet 12 abuts against the first rib portions 83, the first guide member 90 does not rotate. Afterward, the portion 12*a* of the sheet 12 is transported along the first rib portions 83, and passes through the medium sensor 30 before moving toward the transport rollers 31.

As described above, the transport rollers 31 are controlled not to start rotating for a specific period of time, so that the sheet 12 is pushed into the transport rollers 31 to correct skew thereof. At this moment, as shown in FIG. 15, the sheet 12 is curved, so that the sheet 12 pushes upward the first guide member 90 to rotate in a counterclockwise direction around the shaft portion 92. Afterward, the transport rollers 31 rotate to transport the sheet 12 to the transport rollers 70.

As described above, in the embodiment, the first guide member 90 is disposed on the downstream side of the sheet supply roller 15 to be freely rotatable. Accordingly, when the sheet 12 is pushed into the transport rollers 31, the sheet 12 is uniformly curved, thereby accurately and securely transporting the sheet 12.

Further, the first guide member 90 is to be freely rotatable, thereby absorbing a force applied to the first rib portions 83 when the sheet 12 is curved. Accordingly, it is possible to reduce noise generated when the sheet 12 abuts against the first rib portions 83.

In the embodiments describe above, the printer is explained as an image forming apparatus, and the present invention is applicable to a copier, a facsimile, and a multifunction device. Further, the printer is provided with the image forming units 40Bk, 40Y, 40M and 40C, and may provide with only one image forming unit, or an intermediate transfer belt.

The disclosure of Japanese Patent Application No. 2006-229724, filed on Aug. 25, 2006 is incorporated in the application by reference.

While the invention has been explained with reference to the specific embodiments of the invention, the explanation is illustrative and the invention is limited only by the appended claims.

What is claimed is:

1. A medium transport device comprising:

a sheet supply unit for feeding a medium from a medium storage unit retaining the medium to a transportation path, said sheet supply unit including a sheet supply roller and a separation member contacting with the sheet supply roller;

a first guide member disposed at an inlet of the transportation path on a downstream side of the sheet supply unit in a feeding direction of the medium, said first guide member being arranged to face the sheet supply unit so that the transportation path is situated between the first guide member and the sheet supply unit, said first guide member including a first portion corresponding to the sheet supply unit and a second portion having a shape different from that of the first portion, said first portion being arranged within an arrangement range of the separation member along a width direction of the medium on the downstream side of the separation member in the feeding direction, said first guide member being arranged on a tangential line of the sheet supply roller at a contact point between the sheet supply roller and the separation member so that a leading edge of the medium fed from the medium storage unit abuts against the first guide member; and a second guide member arranged on both sides of the sheet supply roller to face the first guide member so that the transportation path is situated between the first guide member and the second guide member, wherein said first portion includes a first base portion and a first rib portion extending from the first base portion toward the transportation path, said first rib portion includes a first guide surface for guiding the medium, said first guide surface is situated away from the first base portion by a first distance gradually decreasing in the feeding direction, said second portion includes a second base portion and a second rib portion extending from the second base portion toward the transportation path, said second rib portion includes a second guide surface for guiding the medium, said second guide surface is situated away from the second base portion by a second distance gradually decreasing in the feeding direction, and said first distance is greater than the second distance at an uppermost stream portion of the first guide member.

2. The medium transport device according to claim 1, wherein said sheet supply unit is disposed at a center in a width direction of the medium, said first portion corresponding to the center.

3. The medium transport device according to claim 1, wherein said first guide member is arranged so that the medium abuts against the first guide member at an angle $\theta t$ within a range of $0° < \theta t < 45°$.

4. The medium transport device according to claim 1, wherein said second portion includes a portion having a length in a vertical direction larger than that of the first portion.

5. The medium transport device according to claim 1, wherein said first guide member is supported by the second portion to be freely rotatable.

6. An image forming apparatus comprising the medium transport device according to claim 1.

7. The medium transport device according to claim 1, wherein a difference between the first distance and the second distance gradually decreases in the feeding direction.

8. The medium transport device according to claim 1, wherein the first base portion and the second base portion lie in a same imaginary plane.

* * * * *